US009371145B2

(12) United States Patent
Cao

(10) Patent No.: US 9,371,145 B2
(45) Date of Patent: Jun. 21, 2016

(54) CONTROL DEVICE FOR TUBULAR MATERIAL PACKAGE

(75) Inventor: Weilong Cao, Shanghai (CN)

(73) Assignee: SHANGHAI HONGQUE ELECTRONIC TECHNOLOGY CO., LTD.

( * ) Notice: Subject to any disclaimer, the term of this patent is extended or adjusted under 35 U.S.C. 154(b) by 521 days.

(21) Appl. No.: 13/882,187

(22) PCT Filed: Mar. 2, 2012

(86) PCT No.: PCT/CN2012/071887

§ 371 (c)(1),
(2), (4) Date: Jun. 24, 2013

(87) PCT Pub. No.: WO2013/029356

PCT Pub. Date: Mar. 7, 2013

(65) Prior Publication Data

US 2013/0276414 A1 Oct. 24, 2013

(51) Int. Cl.

| | |
|---|---|
| ***B65B 5/02*** | (2006.01) |
| ***B65B 9/13*** | (2006.01) |
| ***B65B 9/14*** | (2006.01) |
| ***B65B 57/00*** | (2006.01) |
| ***B65B 61/02*** | (2006.01) |

(52) U.S. Cl.

CPC . *B65B 5/022* (2013.01); *B65B 9/13* (2013.01); *B65B 9/14* (2013.01); *B65B 57/00* (2013.01); *B65B 61/025* (2013.01)

(58) Field of Classification Search

CPC ..... B65B 5/022; B65B 9/13; B65B 9/14; B65B 57/00; B65B 61/025

See application file for complete search history.

(56) References Cited

U.S. PATENT DOCUMENTS

| | | | | |
|---|---|---|---|---|
| 9,216,833 | B2 * | 12/2015 | Cao | B65B 35/30 |
| 2013/0174516 | A1 * | 7/2013 | Cao | B65B 1/28 53/381.1 |
| 2013/0196838 | A1 * | 8/2013 | Cao | B65B 57/04 493/186 |
| 2013/0203574 | A1 * | 8/2013 | Cao | B31B 19/14 493/17 |
| 2013/0212979 | A1 * | 8/2013 | Cao | B65B 7/00 53/285 |
| 2013/0255185 | A1 * | 10/2013 | Cao | B65B 35/30 53/147 |
| 2013/0276414 | A1 * | 10/2013 | Cao | B65B 57/00 53/574 |

* cited by examiner

*Primary Examiner* — Andrew M Tecco
*Assistant Examiner* — Praachi M Pathak
(74) *Attorney, Agent, or Firm* — Kening Li; Miller Canfield

(57) ABSTRACT

A control device for a tubular material package is provided which achieves control of a tubular material package by the effective cooperation of relays (44), sensors (27) and a controller (60). All of the relays have an ON state and an OFF state and are connected to the controller, and each relay is connected to a corresponding component. The sensors are distributed on the components, and capable of detecting and identifying the current state of an object to be detected; all of the sensors are connected to the controller and send sensing information to the controller. The controller comprises electronics and a control program, and is capable of receiving the information from the sensors and sending instructions controlling the relays. The control device is used in a packing machine for tubular materials.

2 Claims, 3 Drawing Sheets

CONTROL DEVICE FOR TUBULAR MATERIAL PACKAGE

FIELD OF THE INVENTION

The invention concerns a packaging machine, especially a pillow-type packaging machine.

BACKGROUND

The present pillow-type packaging is to vertically seal up the slices of the packaging materials from the left and right into a complete cavity, while the objects to be packaged are set inside, and then the cavity is cut off and sealed from two ends of the objects, thus resulting in a pillow-like package, which accounts for the name. The whole packaging procedure is highly automatic with a quick pace, applicable for massive, granular, powdery, and liquid objects, as for food like biscuits, yolk pie, chocolate, bread, fast noodles, moon cake, soya-bean milk, milk, soybean sauce, cooking wine, lotus root starch and etc.; and also applicable for the packaging for various commodities, industrial components and medical mechanics. There emerge many specialized techniques and patents on the pillow-type packaging machine.

It is quite a satisfactory form of pillow packaging, during which the slices of materials are sealed up into a cavity meanwhile the object to be packaged are set into the cavity. However, it also comes in with the following disadvantages: 1. A big consumption of packaging materials. The present packaging is completed by stitching up the slices of packaging materials from the left and right, which results in a big consumption of the packaging materials in the stitching part. 2. A bad outlook. The stitches are left outside the completed package. 3. Multi-layer composite material is demanded for packaging materials, leading to a high cost. 4. Compared to tubular type packaging, pillow-type packaging has one more process, leading to a higher cost and waste of the energy.

Compared with the mentioned packaging techniques based on slices of materials, tubular type packaging involves no stitching, resulting in a decrease of the materials needed by 20%, and no multi-layer composite material. Tubular material package has an advantage of lower cost, a better outlook, better energy efficiency and inexpensiveness.

However, due to the packaging form of the tubular materials, there exist no corresponding techniques on how to make an open end on the top of the curly slices of tubular materials, how to keep tubular materials with an open end move, how to ensure the object to be packaged move correctly and steadily into the tubular materials through the open end, how to automatically conceive of a new open end after packaging, how to keep the open end open on request and etc. Therefore, the present tubular material packages is conducted manually on process of making openings and feeding materials, which results in a low efficiency and can not meet the demand of packaging with high sanitary requirement.

Chinese Patent "A prop-mouth device for packaging bag of automatic packaging machine for dispensable injectors" (Application No.: 200820162608), Chinese Patent "A bag prop device for bag giving type packaging machine" (Application No.: 2006100527142) and Chinese Patent "A material feeding device for packaging bag of automatic packaging machine for dispensable injectors" (Application No.: 2008100634552) offer some related solutions to the problem, but with no convincing descriptions.

SUMMARY

The purpose of the invention is to offer a control device for a tubular material package.

The principle of the invention is as follows: the controller controls the state of assembly units via relays, as up & down, moving, and open & close. It is the sensors set in different positions that check the instant state of all the assembly units, send the sensed instant state to the controller by the information agreed by both. Then, based on the received information, the controller refers to the corresponding controlling program, and commands assembly units to finish the prescribed actions.

The invention is implemented as follows:

A control device for a tubular material package, comprising a relay for a feeder, a relay for a open end fixer, a relay for a lift of an open end fixer, a relay for a sealer, a relay for a sealer and cutter, a relay for a holder, a relay for a supporting plate, a relay for a connector, a relay for a conveyor belt, a relay for a lift of the clamp, a relay for clamping of the clamp, a relay for a forward of tube feeder, a relay for the backward of tube feeder, a relay for a bar code printer, a detector, and a controller;

wherein all of relays have two states: ON and OFF, each of said relays connects respectively to corresponding assembly unit; all of said relays connect to said controller, receive and execute commands from said controller;

wherein said detector consists of sensors, said sensors distributed on a feeder, a discharger, an open end fixer, a sealer, a sealer and cutter, a holder, a supporting plate, a connector, a conveyor belt, a clamp, a tube feeder, and a bar code printer, able to detect and determine the instant states of the object to be detected, all of said sensors connect to said controller, and all of said sensors send the information sensed to said controller;

wherein said controller comprises electronic elements and controlling programs, able to receive the information sensed by sensors and send the controlling commands to said relays, said controller capable of displaying the operation information;

wherein the normal state of said relay for the feeder is OFF, and when the state is ON, the feeder conveys objects to be packaged into the discharger once, and sensor a sends a message of feeding;

wherein the normal state of said relay for the open end fixer is ON, and when the state is ON, said open end fixer opens; when the state is OFF, said open end fixer closes; when said open end fixer opens, sensor b sends a message that said open end fixer opens; when said open end fixer closes, sensor c sends a message that said open end fixer closes;

wherein the normal state of said relay for the lift of the open end fixer is OFF, and when the state is OFF, said open end fixer falls to the original position ; when the state is ON, said open end fixer moves up to the designated position; when said open end fixer stays down in its original position, sensor d sends a message that said open end fixer stays in its original position; when said open end fixer arrives to its designated position, sensor e sends a message that said open end fixer arrives to its designated position;

wherein the normal state of said relay for the sealer is ON; when the state is ON, said sealer opens; when the state is OFF, the sealer closes once; when said sealer opens, sensor f sends a message that said sealer opens; when said sealer closes, sensor g sends a message that said sealer closes;

wherein the normal state of said relay for the sealer and cutter is ON; when the state is ON, said sealer and cutter opens; when the states is OFF, said sealer and cutter closes once; when said sealer and cutter opens, sensor h sends a message that said sealer and cutter opens; when said sealer and cutter closes, sensor i sends a message that sealer and cutter closes;

wherein the normal state of said relay for the holder is ON and when the state is ON, said holder opens; when the state is OFF, said holder closes; when said holder opens, sensor j sends a message that said holder opens; when holder closes, sensor k sends a message that said holder closes;

wherein the normal state of said relay for the supporting plate is ON, and when the state is ON, said supporting plate opens; when the state is OFF, said supporting plate closes; when said supporting plate opens, sensor l sends a message that said supporting plate opens; when said supporting plate closes, sensor m sends a message that said supporting plate closes;

wherein the normal state of said relay for the connector is OFF; when the state is OFF, said connector stays in its original position; when the state is ON, said connector moves to its designated position; when said connector stays in its original position, sensor n sends a message that said connector stays in its original position; when said connector arrives to its designated position, sensor o sends a message that said connector arrives to its designated position;

wherein the normal state of said relay for the conveyor belt is ON, and when the state is ON, said conveyor belt moves in circle; When the state is OFF, said conveyor belt stays still; when said conveyor belt moves, sensor p sends a message that said conveyor belt moves; when said conveyor belt stays still, sensor q sends a message that said conveyor belt stays still;

wherein the normal state of said relay for the lift of the clamp is OFF and when the state is OFF, said clamp falls to its original position; when the state is ON, said clamp moves up to its designated position; when said clamp stays in its original position, sensor r sends a message that said clamp stays in its original position; when clamp moves up to its designated position, sensor s sends a message that said clamp moves up to its designated position;

wherein the normal state of said relay for the clamping of the clamp is ON and when the state is ON, said clamp opens; when the state is OFF, said clamp closes; when said clamp opens, sensor t sends a message that said clamp opens; when said clamp closes, sensor u sends a message that said clamp closes;

wherein the normal state of said relay for the forward of tube feeder is OFF; when the state is ON, said tube feeder moves forward and feeds tubes; when tube feeder moves forward, sensor v sends a message that said tube feeder moves forward; when said tube feeder stays still, sensor w sends a message that said tube feeder stays still;

wherein the normal state of the relay for the backward of tube feeder is OFF and when the state is ON, said tube feeder moves backward and pulls tubes; when said tube feeder moves backward, sensor x sends a message that said tube feeder moves backward; when said tube feeder stays still, sensor w sends a message that said tube feeder stays still;

wherein the normal state of the relay for the bar code printer is OFF and when the state is ON, the date of production will be printed onto tubular materials;

wherein the normal state of sensor z for label checking is ON and when it detects said label, sensor z sends a message of label.

One control loop of said controller comprising:

1). when no information of label from the sensor z received, commanding said relay for the backward of tube feeder to be ON, waiting for the information from the sensor z of said label;

2). when the information of said label from the sensor z received, commanding said relay for the clamping of the clamp to be OFF, waiting for the information from the sensor u that said clamp closes;

3). when the information from the sensor u that said clamp closes received, commanding said relay for the lift of the clamp to be ON, waiting for the information that said clamp arrives to the designated position from the sensor s; commanding said relay for the forward of tube feeder to be ON, waiting for the information from the sensor v that said tube feeder moves forward;

4). When the information from the sensor s that said clamp arrives to the designated position and the information from sensor v that said tube feeder moves forward received, commanding said relay for the open end fixer to be OFF, waiting for the information from the sensor c that said open end fixer closes; commanding said relay for the forward of tube feeder to be OFF, waiting for the information from the sensor w that said tube feeder stays still;

5). when the information from the sensor c that said open end fixer closes and the information from the sensor w that said tube feeder stays still received, commanding said relay for the clamping of the clamp to be ON, waiting for the information from the sensor t that said clamp opens;

6). when the information from sensor t that clamp opens received, commanding said relay for the lift of the clamp to be OFF, waiting for the information from the sensor r that said clamp stays in its original position;

7). when the information from the sensor r that said clamp stays in its original position received, commanding said relay for the sealer and cutter to be OFF, waiting for the information from that sensor i of said sealer and cutter closes;

8). when the information from the sensor i that said sealer and cutter closes received, commanding said relay for the supporting plate to be OFF, waiting for the information from the sensor m that said supporting plate closes;

9). when the information from the sensor m that supporting plate closes received, commanding said relay 30 for the feeder to be ON, waiting for the information from the sensor a of feeding materials;

10). when the information from the sensor a of feeding materials received, commanding said relay for the holder to be OFF, waiting for the information from the sensor k that said holder closes;

11). when the information from the sensor k that said holder closes received, commanding said relay for the open end fixer to be ON, waiting for the information from the sensor b that said open end fixer opens;

12). when the information from the sensor b that open end fixer opens received, commanding said relay for the lift of the open end fixer to be ON, waiting for the information from the sensor e that said open end fixer arrives to the designated position;

13). when the information from the sensor e that said open end fixer arrives to the designated position received, commanding the relay for the sealer to be OFF, waiting for the information from the sensor g that sealer closes;

14). when the information from the sensor g that said sealer closes received, commanding said relay for the sealer to be ON, waiting for the information from the sensor f that said sealer opens;

15). when the information from the sensor f that said sealer opens received, commanding said relay for the connector to be ON, waiting for the information from the sensor o that said connector arrives to the designated position;

16). when the information from the sensor o that said connector arrives to the designated position received, commanding said relay for the holder to be ON, waiting for the information from the sensor j that said holder opens, and said relay for the supporting plate to be ON, waiting for the information from the sensor l that said supporting plate opens;

17). when the information from the sensor j that said holder opens and the information from the sensor l that said supporting plate opens received, commanding said relay for the connector to be OFF, waiting for the information from the sensor n that said connector arrives to its original position; commanding said relay for the lift of the open end fixer to be OFF, waiting for the information from the sensor d that said open end fixer arrives to its original position;

18). when the information from the sensor n that connector said arrives to its designated position, the information from the sensor d that said open end fixer arrives to its designated position, the information from the sensor b that said open end fixer opens, the information from the sensor t that said clamp opens, the information from the sensor j that said holder opens, the information from the sensor l that said supporting plate opens, the information from the sensor h that said sealer and cutter opens, and the information from the sensor f that said sealer opens received, starting a new loop.

The advantage of the invention is that the device controls the operation of all assembly units concisely and steadily.

In figures: 01: sensor a, 02: sensor b, 03: sensor c, 04: sensor d, 05: sensor e, 06: sensor f, 07: sensor g, 08: sensor h, 09: sensor i, 10: sensor j, 11: sensor k, 12: sensor l, 13: sensor m, 14: sensor n, 15: sensor o, 16: sensor p, 17: sensor q, 18: sensor r, 19: sensor s, 20: sensor t, 21: sensor u, 22: sensor v, 23: sensor w, 24: sensor x, 25: sensor y, 26: sensor z, 27: sensors, 28: detector,

30: relay for a feeder, 31: relay for a open end fixer, 32: relay for a lift of the open end fixer, 33: relay for a sealer, 34: relay for a sealer and cutter, 35: relay for a holder, 36: relay for a supporting plate, 37: relay for a connector, 38: relay for a conveyor belt, 39: relay for a lift of the clamp, 40: relay for the clamping of the clamp, 41: relay for the forward of tube feeder, 42: relay for the backward of tube feeder, 43: relay for the bar code printer, 44: relays,

50: feeder, 51: discharger, 52: open end fixer, 53: sealer, 54: sealer and cutter, 55: holder, 56: supporting plate, 57: connector, 58: conveyor belt, 59: clamp, 60: controller, 61: tube feeder, 62: bar code printer, 63: tubular materials, 64: objects to be packaged, 65: label.

EMBODIMENTS CARRYING OUT THE INVENTION

Figure 1:
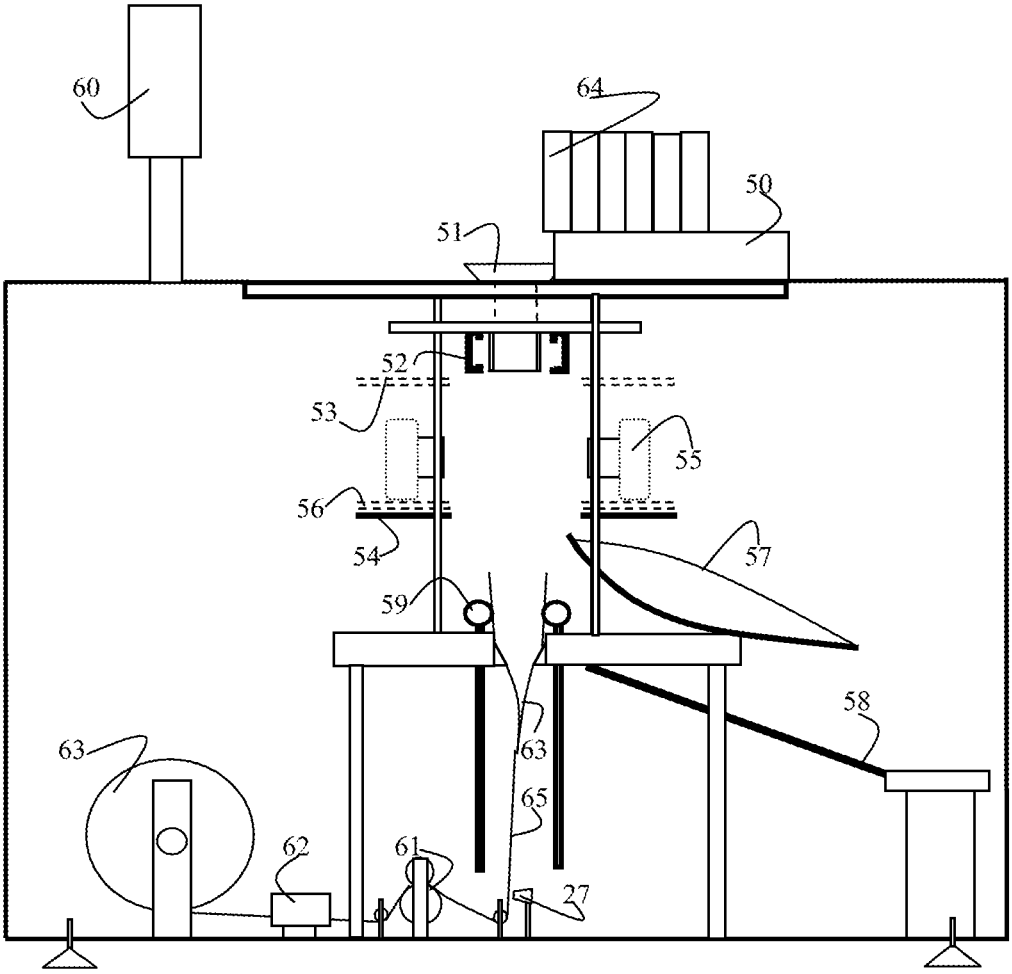
FIG. 1 is the side view of the structure of the embodiment.

Referring to FIG. 1, FIG. 1 is the side view of the structure of the embodiment, where 50 is a feeder, 51 is a discharger, 52 is an open end fixer, 53 is a sealer, 54 is a sealer and cutter, 55 is a holder, 56 is a supporting plate, 57 is a connector, 58 is a conveyor belt, 59 is a clamp, 60 is a controller, 61 is a tube feeder, 62 is a bar code printer, 63 are tubular materials, 64 is are objects to be packaged, and 65 is a label.

The controller 60 comprises electronic elements, as integrated circuits and etc., and controlling programs, which receives the information from sensors 27 and sends controlling commands to relays 44. The controller 60 is also able to display the operation information.

The sensors 27 are distributed on the assembly units mentioned above, which are not illustrated one by one in figures. Each of the sensors can detect and determine the instant state of the object being checked. All of the sensors 27 are connected to the controller 60 and the sensors 27 convey the information sensed to the controller 60.

Each of the relays 44 are connected to the assembly units mentioned above. All the relays 44 are connected to the controller 60, and receive and execute the commands from the controller 60. The relays 44 are not illustrated one by one in figures.

Each of the relays 44 has two states: ON and OFF, the normal state of which refers to the state pre-set by the controller 60. In the following, the requirement of what the assembly units are assumed to meet will be depicted, and the assembly units are connected to the relays 44 under two states. And the corresponding reactions of the sensors 27 will also be depicted when the assembly units change their states.

The normal state of the relay 30 for the feeder is OFF. When the status is ON, the feeder 50 will convey the objects 64 to be packaged into the discharger 51 once. When the feeder 50 will convey the objects 64 to be packaged into the discharger 51 once, sensor a 01 sends a message of feeding.

The normal state of the relay 31 for the open end fixer is ON. When the state is ON, the open end fixer 52 opens; when the state is OFF, the open end fixer 52 closes and is able to fix the open end of the tubular materials 63. When the open end fixer 52 opens, sensor b 02 sends a message that the open end fixer 52 opens; when the open end fixer 52 closes, sensor c 03 sends a message that the open end fixer 52 closes.

The normal state of the relay 32 for the lift of the open end fixer is OFF. When the status is OFF, the open end fixer 52 stays down; when the state is ON, the open end fixer 52 moves up to the designated position. When the open end fixer 52 stays down in its original position, sensor d 04 sends a message that the open end fixer 52 stays in its original position. When the open end fixer 52 arrives to its designated position, sensor e 05 sends a message that the open end fixer 52 arrives to its designated position.

The normal state of the relay 33 for the sealer is ON. When the state is ON, the sealer 53 opens; when the state is OFF, the sealer 53 closes once. When the sealer 53 opens, sensor f 06 sends a message that the sealer 53 opens. When the sealer 53 closes, sensor g 07 sends a message that the sealer 53 closes.

The normal state of the relay 34 for the sealer and cutter is ON. When the status is ON, the sealer and cutter 54 opens; when the state is OFF, the sealer and cutter 54 closes once. When the sealer and cutter 54 opens, sensor h 08 sends a message that the sealer and cutter 54 opens. When the sealer and cutter 54 closes, sensor i 09 sends a message that the sealer and cutter 54 closes.

The normal state of the relay 35 for the holder is ON. When the state is ON, the holder 55 opens; when the state is OFF, the holder 55 closes. When the holder 55 opens, sensor j 10 sends a message that the holder 55 opens. When the holder 55 closes, sensor k 11 sends a message that the holder 55 closes.

The normal state of the relay 36 for the supporting plate is ON. When the state is ON, the supporting plate 56 opens; when the status is OFF, the supporting plate 56 closes. When the supporting plate 56 opens, sensor l 12 sends a message that the supporting plate 56 opens. When the supporting plate 56 closes, sensor m 13 sends a message that the supporting plate 56 closes.

The normal state of the relay 37 for the connector is OFF. When the state is OFF, the connector 57 stays in its original position; when the state is ON, the connector 57 moves to its designated position. When the connector 57 stays in its original position, sensor n 14 sends a message that the connector 57 stays in its original position. When the connector 57 arrives to its designated position, sensor o 15 sends a message that the connector 57 arrives to its designated position.

The normal state of the relay 38 for the conveyor belt is ON. When the state is ON, the conveyor belt 58 moves in circle; when the state is OFF, the conveyor belt 58 stays still. When the conveyor belt 58 moves, sensor p 16 sends a message that the conveyor belt 58 moves. When the conveyor belt 58 stays still, sensor q 17 sends a message that the conveyor belt 58 stays still.

The normal state of the relay 39 for the lift of the clamp is OFF. When the state is OFF, the clamp 59 stays down in its original position; when the state is ON, the clamp 59 moves up to its designated position. When the clamp 59 stays down in its original position, sensor r 18 sends a message that the clamp 59 stays down in its original position. When the clamp 59 moves up to its designated position, sensor s 19 sends a message that the clamp 59 moves up to its designated position.

The normal state of the relay 40 for the clamping of the clamp is ON. When the state is ON, the clamp 59 opens; when the state is OFF, the clamp 59 closes. When the clamp 59 opens, sensor t 20 sends a message that the clamp 59 opens. When the clamp 59 closes, sensor u 21 sends a message that the clamp 59 opens.

The normal state of the relay 41 for the forward of tube feeder is OFF. When the status is ON, the tube feeder 61 moves forward and feeds tubes; when the tube feeder 61 moves forward, sensor v 22 sends a message that the tube feeder 61 moves forward. When the tube feeder 61 stays still, sensor w 23 sends a message that the tube feeder 61 stays still.

The normal state of the relay 42 for the backward of tube feeder is OFF. When the state is ON, the tube feeder 61 moves backward and pulls tubes; when the tube feeder 61 moves backward, sensor x 24 sends a message that the tube feeder 61 moves backward. When the tube feeder 61 stays still, sensor w 23 sends a message that the tube feeder 61 stays still.

The normal state of the relay for the bar code printer 43 is OFF. When the state is ON, the date of production will be printed onto the tubular materials 63.

The normal state of sensor z 26 for label checking is ON. When it detects the label 65, sensor z 26 sends a message of the label 65.

Figure 2:
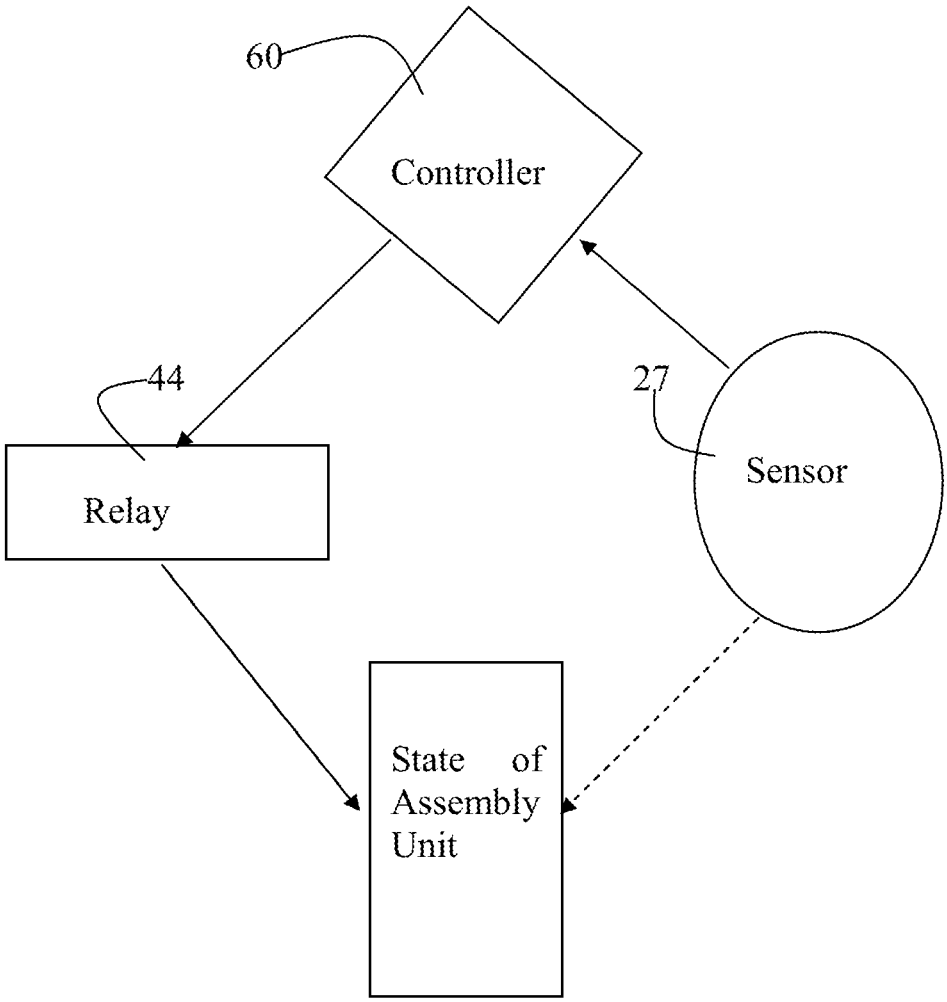
FIG. 2 is the illustration of the basic controlling scheme of the embodiment.

Referring to FIG. 2, FIG. 2 is the illustration of basic controlling scheme of the embodiment, showing the relationships of the controller 60, sensors 27 and the relays 44.

As shown in the figure, the controller 60 is able to command the relays 44 to be on or off. The relays 44 connect to the related assembly units. During the turning of one of the relays 44 to be on or off, the assembly unit connected to it turns to an expected status.

The sensors 27 check the state of the assembly units. Checking is presented as the dotted line. When a change of state of a certain assembly unit is detected, the sensed information is sent to the controller 60. Based on the information offered by the sensors 27, the controller 60 gives the corresponding assembly units an order to turn into a certain state through the relays 44. The procedure as mentioned above is conducted repeatedly.

Figure 3:
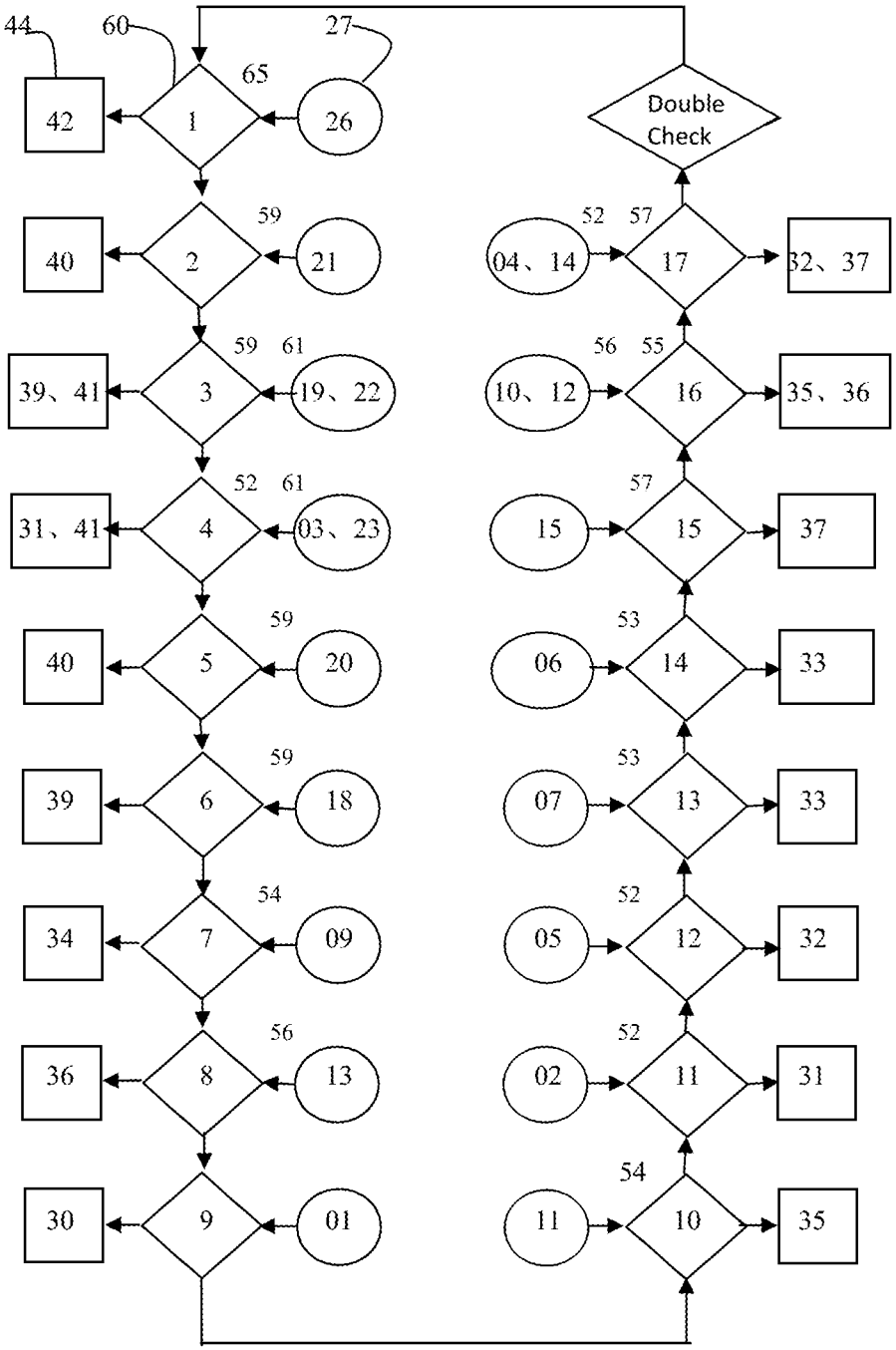
FIG. 3 is the illustration of the partial controlling scheme of the embodiment.

Referring to FIG. 3, FIG. 3 is the illustration of one loop of the controlling scheme of the embodiment.

In the figure, 44 are relays. The relays 44 are controlled by the commands of the controller 60. In the figure, numbers in squares "□" represent the order number of the relays 44.

60 is the controller. In the figure, numbers in diamonds "◇" represent the controlling steps of controller 60.

27 are the sensors. The sensors 27 send the sensed information to the controller 60. In the figure, numbers in circles "○" represent the order numbers of the sensors 27. Numbers up and down the arrows represent the order numbers of the assembly units.

The procedure is depicted by the order numbers in diamonds "◇".

1. When the controller receives no information of the label 65 from the sensor z 26, it commands the relay 42 for the backward of the tube feeder to be on, waiting for the information from the sensor z 26 of label 65.

2. When the controller 60 receives the information of the label 65 from the sensor z 26, it commands the relay 40 for the clamping of the clamp to be off, waiting for the information from the sensor u 21 that the clamp 59 closes.

3. When the controller 60 receives the information that the clamp 59 closes from the sensor u 21, it commands the relay for the lift of the clamp 39 to be on, waiting for the information from the sensor s 19 that the clamp 59 arrives to the designated position; it commands the relay for the forward of the tube feeder 41 to be on, waiting for the information from the sensor v 22 that the tube feeder 61 moves forward.

4. When the controller 60 receives the information from the sensor s 19 that the clamp 59 arrives to the designated position and the information from sensor v 22 that the tube feeder 61 moves forward, it commands the relay 31 for the open end fixer to be off, waiting for the information from the sensor c 03 that the open end fixer 52 closes; it commands the relay 41 for the forward of the tube feeder to be off, waiting for the information from the sensor w 23 that the tube feeder 61 stays still.

5. When the controller 60 receives the information from the sensor c 03 that the open end fixer 52 closes and the information from the sensor w 23 that the tube feeder 61 stays still, it commands the relay 40 for the clamping of the clamp to be on, waiting for the information from the sensor t 20 that the clamp 59 opens.

6. When the controller 60 receives the information from sensor t 20 that the clamp 59 opens, it commands the relay 39 for the lift of the clamp to be off, waiting for the information from the sensor r 18 that the clamp 59 stays in its original position.

7. When the controller 60 receives the information from the sensor r 18 that the clamp 59 stays in its original position, it commands the relay 34 for the sealer and cutter to be off, waiting for the information from that sensor i 09 of the sealer and cutter 54 closes.

8. When the controller 60 receives the information from the sensor i 09 that the sealer and cutter 54 closes, it commands the relay 36 for the supporting plate to be off, waiting for the information from the sensor m 13 that the supporting plate 56 closes.

9. When the controller 60 receives the information from the sensor m 13 that the supporting plate 56 closes, it commands the relay 30 for the feeder to be on, waiting for the information from the sensor a 01 of feeding materials.

10. When the controller 60 receives the information from the sensor a 01 of feeding materials, it commands the relay 35 for the holder to be off, waiting for the information from the sensor k 11 that the holder 55 closes.

11. When the controller 60 receives the information from the sensor k 11 that the holder 55 closes, it commands the relay 31 for the open end fixer to be on, waiting for the information from the sensor b 02 that the open end fixer 52 opens.

12. When the controller 60 receives the information from the sensor b 02 that the open end fixer 52 opens, it commands the relay 32 for the lift of the open end fixer to be on, waiting for the information from the sensor e 05 that the open end fixer 52 arrives to the designated position.

13. When the controller 60 receives the information from the sensor e 05 that the open end fixer 52 arrives to the designated position, it commands the relay 33 for the sealer to be off, waiting for the information from the sensor g 07 that the sealer 53 closes.

14. When the controller 60 receives the information from the sensor g 07 that the sealer 53 closes, it commands the relay 33 for the sealer to be on, waiting for the information from the sensor f 06 that the sealer 53 opens.

15. When the controller 60 receives the information from the sensor f 06 that the sealer 53 opens, it commands the relay 37 for the connector to be on, waiting for the information from the sensor o 15 that the connector 57 arrives to the designated position.

16. When the controller 60 receives the information from the sensor o 15 that the connector 57 arrives to the designated position, it commands the relay 35 for the holder to be on, waiting for the information from the sensor j 10 that holder 55 opens, and commands the relay 36 for the supporting plate to be on, waiting for the information from the sensor l 12 that the supporting plate 56 opens.

17. When the controller 60 receives the information from the sensor j 10 that the holder 55 opens and the information from the sensor l 12 that the supporting plate 56 opens, it commands the relay 37 for the connector to be off, waiting for the information from the sensor n 14 that the connector 57 arrives to its original position; it commands the relay 32 for the lift of the open end fixer to be off, waiting for the information from the sensor d 04 that the open end fixer 52 arrives to its original position.

18. When the controller 60 receives the information from the sensor n 14 that the connector 57 arrives to its designated position, the information from the sensor d 04 that the open end fixer 52 arrives to its designated position, the information from the sensor b 02 that the open end fixer 52 opens, the information from the sensor t 20 that the clamp 59 opens, the information from the sensor j 10 that the holder 55 opens, the information from the sensor l 12 that supporting plate 56 opens, and the information from the sensor f 06 that the sealer 53 opens is received, it starts a new loop.

What is claimed is:

1. A control device for a tubular material package, comprising a relay (30) for a feeder, a relay (31) for a open end fixer, a relay (32) for a lift of an open end fixer, a relay (33) for a sealer, a relay (34) for a sealer and cutter, a relay (35) for a holder, a relay (36) for a supporting plate, a relay (37) for a connector, a relay (38) for a conveyor belt, a relay (39) for a lift of the clamp, a relay (40) for clamping of the clamp, a relay (41) for a forward of tube feeder, a relay for the backward of tube feeder (42), a relay (43) for a bar code printer, a detector (28), and a controller (60);

wherein all of relays (44) have two states: ON and OFF, each of said relays (44) connects respectively to corresponding assembly unit; all of said relays (44) connect to said controller (60), receive and execute commands from said controller (60);

wherein said detector (28) consists of sensors (27), said sensors (27) distributed on a feeder (50), a discharger (51), an open end fixer (52), a sealer (53), a sealer and cutter (54), a holder (55), a supporting plate (56), a connector (57), a conveyor belt (58), a clamp (59), a tube feeder (61), and a bar code printer (62), able to detect and determine the instant states of the object to be detected, all of said sensors (27) connect to said controller (60), and all of said sensors (27) send the information sensed to said controller (60);

wherein said controller (60) comprises electronic elements and controlling programs, able to receive the information sensed by sensors (27) and send the controlling commands to said relays (44), said controller (60) can display the operation information;

wherein the normal state of said relay (30) for the feeder is OFF, and when the state is ON, the feeder (50) conveys objects (64) to be packaged into the discharger (51) once, and sensor a (01) sends a message of feeding;

wherein the normal state of said relay (31) for the open end fixer is ON, and when the state is ON, said open end fixer (52) opens; when the state is OFF, said open end fixer (52) closes; when said open end fixer (52) opens, sensor b (02) sends a message that said open end fixer (52) opens; when said open end fixer (52) closes, sensor c (03) sends a message that said open end fixer (52) closes;

wherein the normal state of said relay (32) for the lift of the open end fixer is OFF, and when the state is OFF, said open end fixer (52) falls to the original position; when the state is ON, said open end fixer (52) moves up to the designated position; when said open end fixer (52) stays down in its original position, sensor d (04) sends a message that said open end fixer (52) stays in its original position; when said open end fixer (52) arrives to its designated position, sensor e (05) sends a message that said open end fixer (52) arrives to its designated position;

wherein the normal state of said relay (33) for the sealer is ON; when the state is ON, said sealer (53) opens; when the state is OFF, the sealer (53) closes once; when said sealer (53) opens, sensor f (06) sends a message that said sealer (53) opens; when said sealer (53) closes, sensor g (07) sends a message that said sealer (53) closes;

wherein the normal state of said relay (34) for the sealer and cutter is ON; when the state is ON, said sealer and cutter (54) opens; when the states is OFF, said sealer and cutter (54) closes once; when said sealer and cutter (54) opens, sensor h (08) sends a message that said sealer and cutter (54) opens; when said sealer and cutter (54) closes, sensor i (09) sends a message that sealer and cutter (54) closes;

wherein the normal state of said relay (35) for the holder is ON and when the state is ON, said holder (55) opens; when the state is OFF, said holder (55) closes; when said holder (55) opens, sensor j (10) sends a message that said holder (55) opens; when holder (55) closes, sensor k (11) sends a message that said holder (55) closes;

wherein the normal state of said relay (36) for the supporting plate is ON, and when the state is ON, said supporting plate (56) opens; when the state is OFF, said supporting plate (56) closes; when said supporting plate (56) opens, sensor l (12) sends a message that said supporting plate (56) opens; when said supporting plate (56) closes, sensor m (13) sends a message that said supporting plate (56) closes;

wherein the normal state of said relay (37) for the connector is OFF; when the state is OFF, said connector (57) stays in its original position; when the state is ON, said connector (57) moves to its designated position; when said connector (57) stays in its original position, sensor n (14) sends a message that said connector (57) stays in its original position; when said connector (57) arrives to its designated position, sensor o (15) sends a message that said connector (57) arrives to its designated position;

wherein the normal state of said relay (38) for the conveyor belt is ON, and when the state is ON, said conveyor belt (58) moves in circle; When the state is OFF, said conveyor belt (58) stays still; when said conveyor belt (58) moves, sensor p (16) sends a message that said conveyor belt (58) moves; when said conveyor belt (58) stays still, sensor q (17) sends a message that said conveyor belt (58) stays still;

wherein the normal state of said relay (39) for the lift of the clamp is OFF and when the state is OFF, said clamp (59) falls to its original position; when the state is ON, said clamp (59) moves up to its designated position; when said clamp (59) stays in its original position, sensor r (18) sends a message that said clamp (59) stays in its original position; when clamp (59) moves up to its designated position, sensor s (19) sends a message that said clamp (59) moves up to its designated position;

wherein the normal state of said relay (40) for the clamping of the clamp is ON and when the state is ON, said clamp (59) opens; when the state is OFF, said clamp (59) closes; when said clamp (59) opens, sensor t (20) sends a message that said clamp (59) opens; when said clamp (59) closes, sensor u (21) sends a message that said clamp (59) closes;

wherein the normal state of said relay (41) for the forward of tube feeder is OFF; when the state is ON, said tube feeder (61) moves forward and feeds tubes; when tube feeder (61) moves forward, sensor v (22) sends a message that said tube feeder (61) moves forward; when said tube feeder (61) stays still, sensor w (23) sends a message that said tube feeder (61) stays still;

wherein the normal state of the relay (42) for the backward of tube feeder is OFF and when the state is ON, said tube feeder (61) moves backward and pulls tubes; when said tube feeder (61) moves backward, sensor x (24) sends a message that said tube feeder (61) moves backward; when said tube feeder (61) stays still, sensor w (23) sends a message that said tube feeder (61) stays still;

wherein the normal state of the relay (43) for the bar code printer is OFF and when the state is ON, the date of production will be printed onto tubular materials (63);

wherein the normal state of sensor z (26) for label (65) checking is ON and when it detects said label (65), sensor z (26) sends a message of label (65).

2. A control device for a tubular material package according to claim 1 wherein one control loop of said controller (60) comprising:

1). when no information of label (65) from the sensor z (26) received, commanding said relay (42) for the backward of tube feeder to be ON, waiting for the information from the sensor z (26) of said label (65);

2). when the information of said label (65) from the sensor z (26) received, commanding said relay (40) for the clamping of the clamp to be OFF, waiting for the information from the sensor u (21) that said clamp (59) closes;

3). when the information from the sensor u (21) that said clamp (59) closes received, commanding said relay (39) for the lift of the clamp to be ON, waiting for the information that said clamp (59) arrives to the designated position from the sensor s (19); commanding said relay (41) for the forward of tube feeder to be ON, waiting for the information from the sensor v (22) that said tube feeder (61) moves forward;

4). When the information from the sensor s (19) that said clamp (59) arrives to the designated position and the information from sensor v (22) that said tube feeder (61) moves forward received, commanding said relay (31) for the open end fixer to be OFF, waiting for the information from the sensor c (03) that said open end fixer (52) closes; commanding said relay (41) for the forward of tube feeder to be OFF, waiting for the information from the sensor w (23) that said tube feeder (61) stays still;

5). when the information from the sensor c (03) that said open end fixer (52) closes and the information from the sensor w (23) that said tube feeder (61) stays still received, commanding said relay (40) for the clamping of the clamp to be ON, waiting for the information from the sensor t (20) that said clamp (59) opens;

6). when the information from sensor t (20) that clamp (59) opens received, commanding said relay (39) for the lift of the clamp to be OFF, waiting for the information from the sensor r (18) that said clamp (59) stays in its original position;

7). when the information from the sensor r (18) that said clamp (59) stays in its original position received, commanding said relay (34) for the sealer and cutter to be OFF, waiting for the information from that sensor i (08) of said sealer and cutter (54) closes;

8). when the information from the sensor i (08) that said sealer and cutter (54) closes received, commanding said relay (36) for the supporting plate to be OFF, waiting for the information from the sensor m (13) that said supporting plate (56) closes;

9). when the information from the sensor m (13) that supporting plate (56) closes received, commanding said relay (30) for the feeder to be ON, waiting for the information from the sensor a (01) of feeding materials;

10). when the information from the sensor a (01) of feeding materials received, commanding said relay (35) for the holder to be OFF, waiting for the information from the sensor k (11) that said holder (55) closes;

11). when the information from the sensor k (11) that said holder 55 closes received, commanding said relay (31) for the open end fixer to be ON, waiting for the information from the sensor b (02) that said open end fixer (52) opens;

12). when the information from the sensor b (02) that open end fixer (52) opens received, commanding said relay (32) for the lift of the open end fixer to be ON, waiting for the information from the sensor e (05) that said open end fixer (52) arrives to the designated position;

13). when the information from the sensor e (05) that said open end fixer (52) arrives to the designated position received, commanding the relay (33) for the sealer to be OFF, waiting for the information from the sensor g (07) that sealer (53) closes;

14). when the information from the sensor g (07) that said sealer (53) closes received, commanding said relay (33) for the sealer to be ON, waiting for the information from the sensor f (06) that said sealer 53 opens;

15). when the information from the sensor f (06) that said sealer (53) opens received, commanding said relay (37) for the connector to be ON, waiting for the information from the sensor o (15) that said connector (57) arrives to the designated position;

16). when the information from the sensor o (15) that said connector (57) arrives to the designated position received, commanding said relay (35) for the holder to be ON, waiting for the information from the sensor j (10)

that said holder (55) opens, and said relay (36) for the supporting plate to be ON, waiting for the information from the sensor l (12) that said supporting plate (56) opens;

17). when the information from the sensor j (10) that said holder (55) opens and the information from the sensor l (12) that said supporting plate (56) opens received, commanding said relay (37) for the connector to be OFF, waiting for the information from the sensor n (14) that said connector (57) arrives to its original position; commanding said relay (32) for the lift of the open end fixer to be OFF, waiting for the information from the sensor d (04) that said open end fixer (52) arrives to its original position;

18). when the information from the sensor n (14) that connector said (57) arrives to its designated position, the information from the sensor d (04) that said open end fixer (52) arrives to its designated position, the information from the sensor b (02) that said open end fixer (52) opens, the information from the sensor t (20) that said clamp (59) opens, the information from the sensor j (10) that said holder (55) opens, the information from the sensor l (12) that said supporting plate (56) opens, the information from the sensor h (08) that said sealer and cutter (54) opens, and the information from the sensor f (06) that said sealer (53) opens received, starting a new loop.

* * * * *